US006019076A

United States Patent [19]

Pierik et al.

[11] Patent Number: 6,019,076

[45] Date of Patent: Feb. 1, 2000

[54] VARIABLE VALVE TIMING MECHANISM

[75] Inventors: Ronald Jay Pierik, Rochester; John Castellana, Fairport, both of N.Y.

[73] Assignee: General Motors Corporation, Detroit, Mich.

[21] Appl. No.: 09/129,270

[22] Filed: Aug. 5, 1998

[51] Int. Cl.[7] ..... F01L 13/00

[52] U.S. Cl. ..... 123/90.16; 123/90.17

[58] Field of Search ..... 123/90.15, 90.16, 123/90.17, 90.22, 90.31, 90.6

[56] References Cited

U.S. PATENT DOCUMENTS

| | | | |
|---|---|---|---|
| 4,572,118 | 2/1986 | Baguena | 123/90.16 |
| 5,189,998 | 3/1993 | Hara | 123/90.16 |
| 5,253,620 | 10/1993 | Dohn et al. | 123/90.16 |
| 5,327,859 | 7/1994 | Pierik et al. | 123/90.17 |
| 5,501,186 | 3/1996 | Hara et al. | 123/90.16 |
| 5,680,836 | 10/1997 | Pierik | 123/90.17 |
| 5,680,837 | 10/1997 | Pierik | 123/90.17 |
| 5,732,669 | 3/1998 | Fischer et al. | 123/90.16 |
| 5,787,849 | 8/1998 | Mitchell | 123/90.16 |
| 5,899,180 | 5/1999 | Fischer | 123/90.16 |
| 5,937,809 | 8/1999 | Pierik et al. | 123/90.16 |

FOREIGN PATENT DOCUMENTS

19629349-A1 1/1998 Germany .

*Primary Examiner*—Weilun Lo
*Attorney, Agent, or Firm*—Vincent A. Cichosz

[57] ABSTRACT

Variable valve timing (VVT) mechanisms are disclosed which are relatively compact and are applicable for operating individual or multiple valves. In an exemplary embodiment, dual engine valves are driven by an oscillatable rocker cam that is actuated by a linkage driven by a rotary cam. The linkage is pivoted on a control member that is in turn pivotable about the axis of the rotary cam and angularly adjustable to vary the orientation of the rocker cam and thereby vary the valve lift and timing. The rotary cam is carried on a camshaft and the oscillatable rocker cam is pivoted on the rotational axis of the rotary cam. A control shaft connects with the control member through an angled slider and slot connection that provides a variable angular ratio for improved charge control at low valve lifts. A worm gear actuator may be applied to drive the control shaft. The tooth angles is selected to prevent back driving of the worm drive motor by varying cam torques on the control member so that a smaller drive motor may be used. Other alternative arrangements are disclosed.

8 Claims, 6 Drawing Sheets

VARIABLE VALVE TIMING MECHANISM

This invention relates to variable valve timing mechanisms and, more particularly, to valve actuating mechanisms for varying the lift and timing of engine valves.

BACKGROUND OF THE INVENTION

It is known in the automotive engine art that the provision of variable valve timing (VVT) and/or variable valve lift valve actuating mechanisms has the capability for potentially improving the system performance of an engine by reducing pump work and valve train friction, controlling engine load and internal exhaust dilution, improving charge preparation, increasing peak power and enabling the use of various transient operation control strategies not otherwise available. A myriad of VVT mechanisms have been disclosed in the prior art but the use of such mechanisms has been relatively limited. This has been due in part to their size, cost and/or operating limitations which have limited their practicality and potential value in real production engine applications.

U.S. Pat. No. 5,937,809, assigned to the assignee of the present invention, discloses variable valve timing (VVT) mechanisms which are relatively compact, and are applicable for operating individual or multiple valves. In these mechanisms, an engine valve is driven by an oscillating rocker cam that is actuated by a linkage driven by a rotary eccentric, preferably a rotary cam. The linkage is pivoted on a control member that is, in turn, pivotable about the axis of the rotary cam and angularly adjustable to vary the orientation of the rocker cam and thereby vary the valve lift and timing. The rotary cam may be carried on a camshaft. The oscillating cam is pivoted on the rotational axis of the rotary cam.

SUMMARY OF THE INVENTION

The present invention provides a modified mechanism of the type described above and in application U.S. Pat. No. 5,937,809, but having additional features intended for application in a particular engine and optionally usable in other applications of the mechanism.

In a particular embodiment, the mechanism of the invention includes a rotary camshaft having a single rotary cam for each cylinder of an associated engine. The cam engages a roller follower of a primary lever, or rocker lever, that pivots at one end about a control member, or frame. An opposite end connects through a bifurcated link with outer ends of a pair of secondary levers each pivotable about the camshaft axis and carrying an oscillating cam. The oscillating cams engage roller finger followers each pivoting on a stationary lash adjuster and engaging one of dual inlet valves for an engine cylinder. The arrangement positions the rocker lever pivot generally between the pivot ends of the finger followers and provides an efficient packaging of the mechanism in the available engine space. Flat spiral springs are provided, acting between the secondary levers and the control member or frame to maintain the rocker lever roller follower in contact with the rotary cam.

The control member or frame is also pivotable on the camshaft axis and may be adjusted through a predetermined range of phase angles by oscillation of a control shaft carrying an actuating pin engagable with a slot of the control member to pivot the control member with a varying angular ratio providing desired control characteristics. A flattened bushing on the actuating pin reduces wear from sliding in the slot and may be replaced to maintain minimum clearance or backlash in the system. Adjustment of the control member varies the range of fixed angular oscillation of the oscillating cams from a range in which the finger followers are actuated to fully open at least one of the valves to a range in which minimum or no opening of the valves is provided.

The control shaft may be actuated by a worm drive including a worm gear engaged by a worm driven by a small electric motor. The tooth angles of the worm and gear are selected to lock up the drive when back drive forces on the oscillating shaft exceed the force of the drive motor, allowing the shaft to move only in the direction of the power applied by the motor.

These and other features and advantages of the invention will be more fully understood from the following description of certain specific embodiments of the invention taken together with the accompanying drawings.

DESCRIPTION OF THE PREFERRED EMBODIMENT

Figure 1:
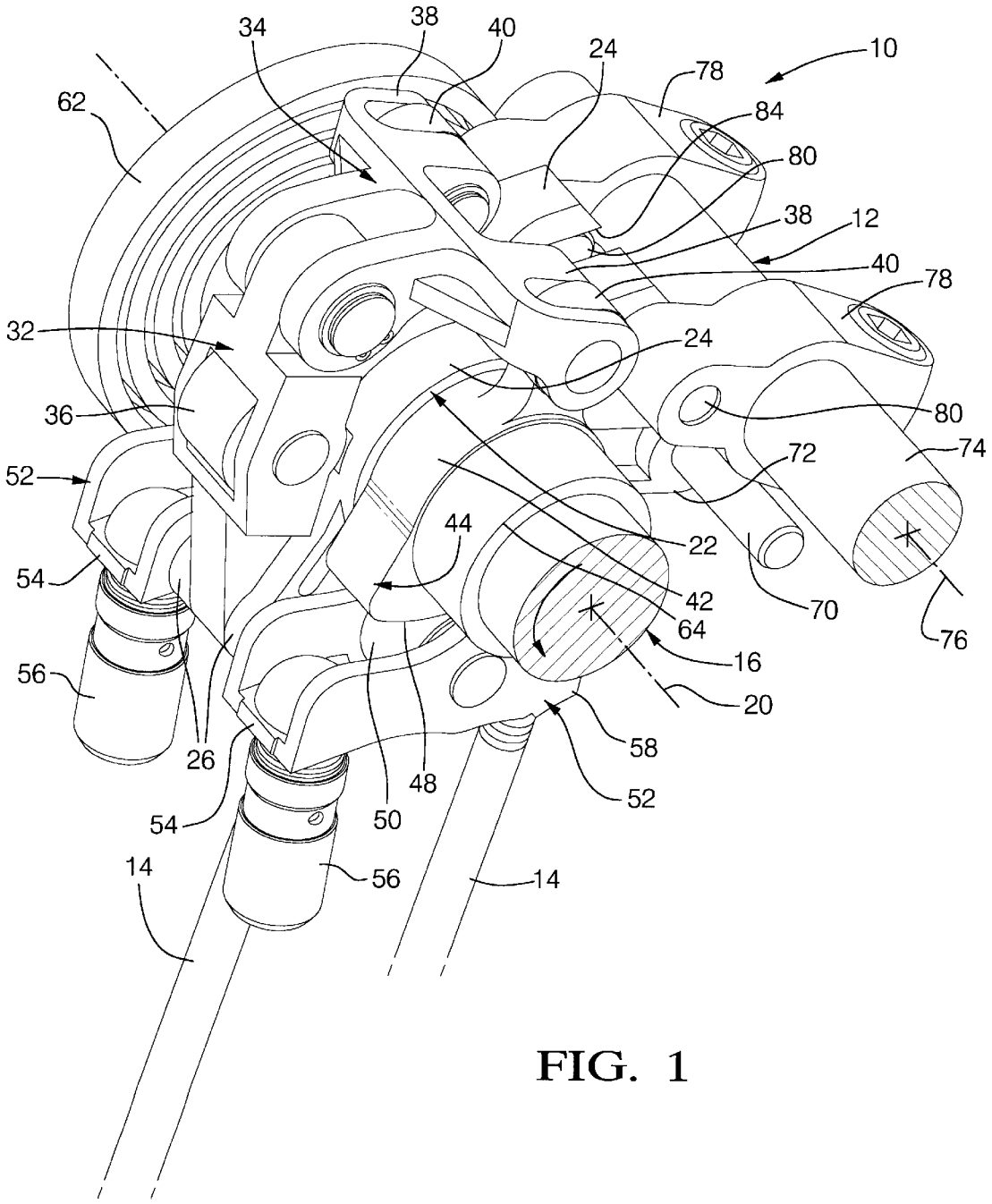
FIG. 1 is a pictorial inside view of a selected embodiment of the variable valve timing mechanism of the invention with one of two spiral biasing springs omitted for clarity.

Referring first to FIGS. 1–4 of the drawings, numeral 10 generally indicates a portion of an internal combustion engine 10 including a valve actuating mechanism 12 operative to actuate dual inlet valves 14 for a single cylinder of the engine. Mechanism 12 includes a rotary camshaft 16 which extends the length of the cylinder head, not shown, of a four cylinder engine, of which the mechanism for only a single cylinder is illustrated. The camshaft 16 may be conventionally driven such as by a chain or other means from the engine crankshaft.

Figure 3:
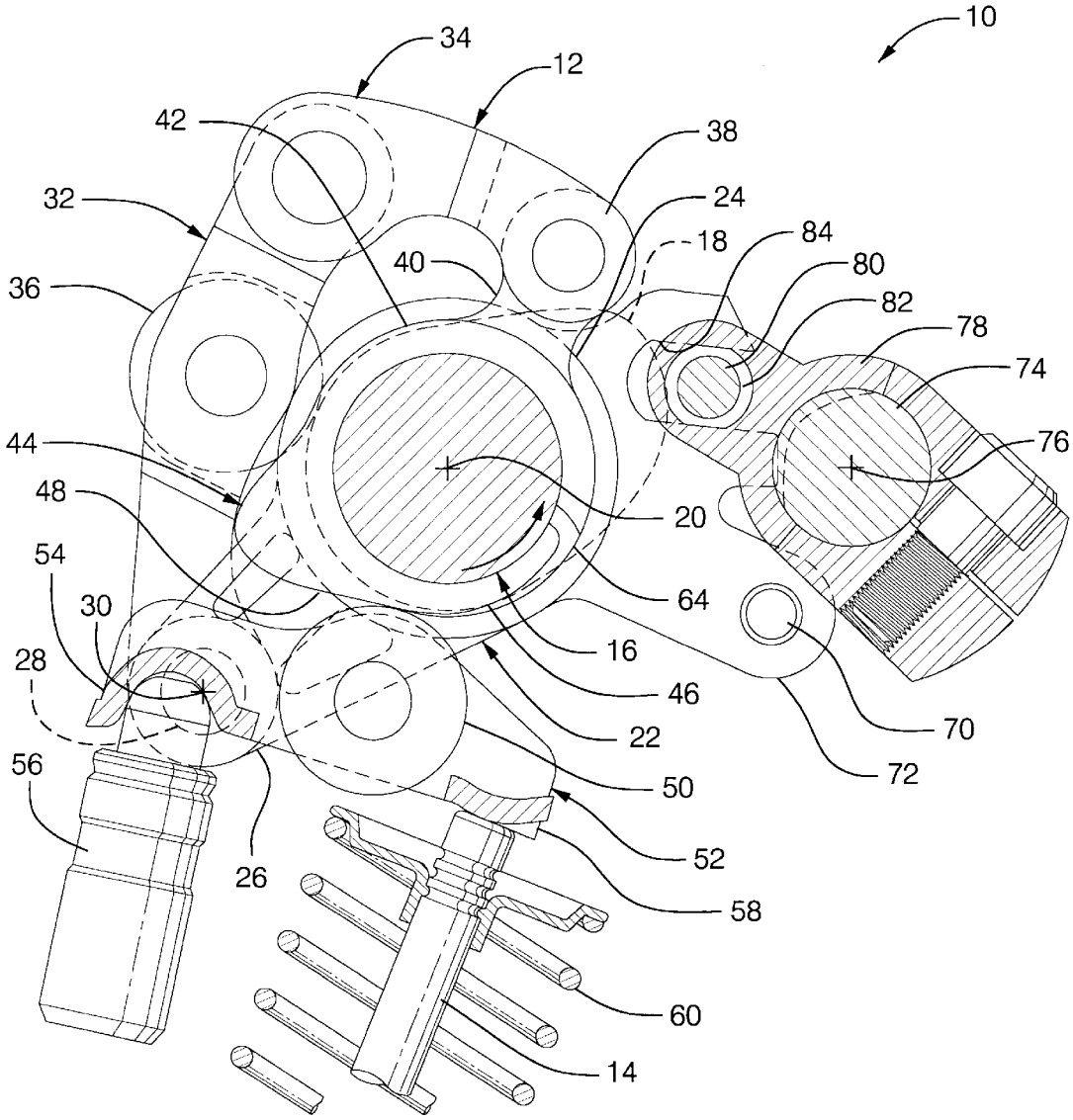
FIG. 3 is a cross-sectional end view of the mechanism of FIG. 1 with the spiral biasing springs omitted and showing the high valve lift position.
Figure 4:
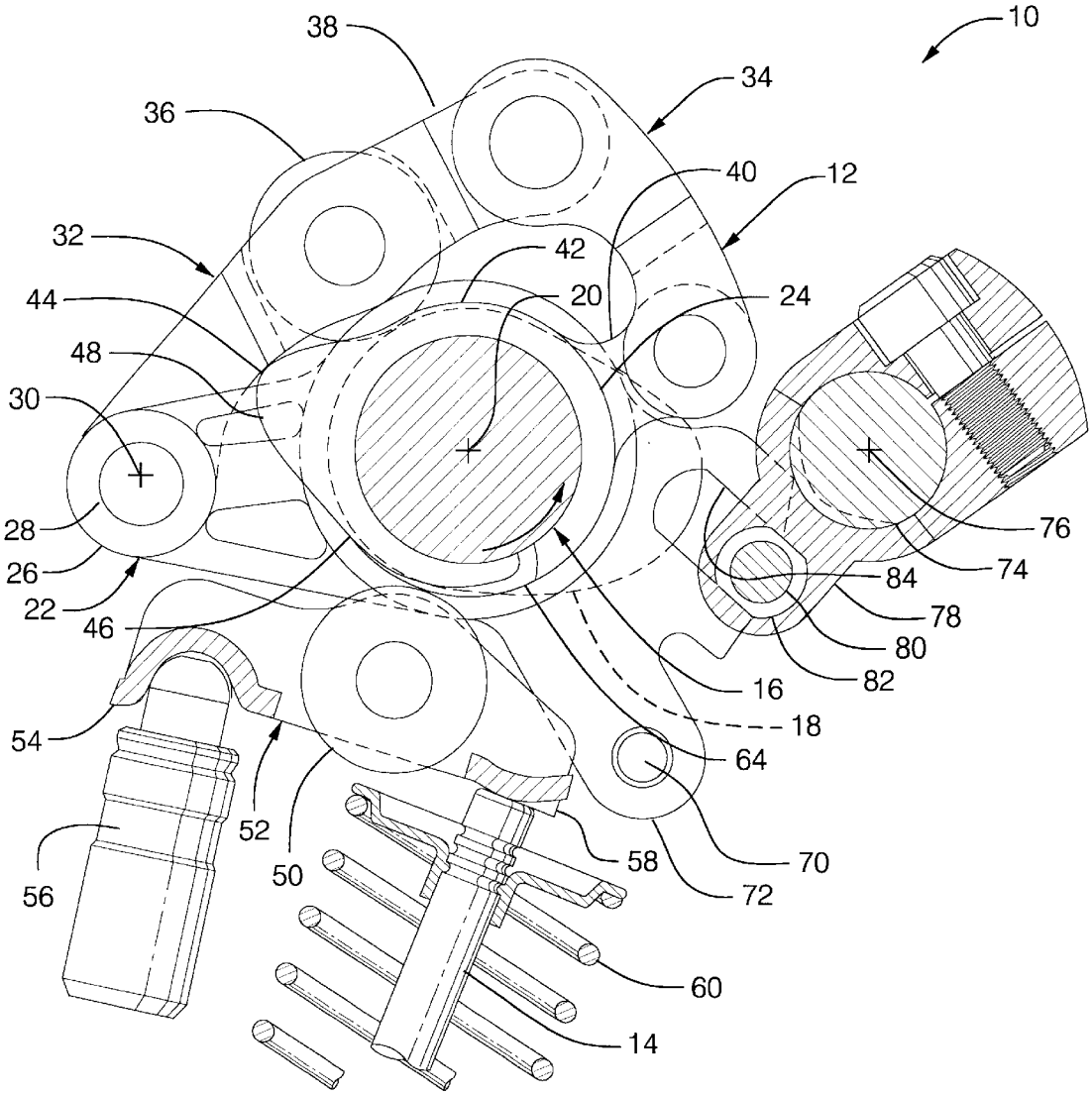
FIG. 4 is a cross-sectional end view similar to FIG. 2 but showing the low lift position of the mechanism.

Camshaft 16 carries a rotary cam 18 which rotates, counterclockwise as shown in FIGS. 1, 3 and 4 about a primary axis 20. A control member (or frame) 22 is mounted on the camshaft for pivotal motion also about the primary axis 20. The control member is formed by a pair of frame elements 24 extending on either side of the rotary cam and connected by two pins to be later described, thus forming an assembled frame.

The control member includes a pair of pivot arms 26 connected at outer ends by a pivot pin 28 that forms part of the control member or frame 24 and is located on a first pivot axis 30. A rocker lever or primary lever 32 is pivotally mounted at one end to the pivot pin 28 which connects it to the control member 22. A distal end of the rocker lever 32 is pivotally connected to by a pin to a link 34. Between its ends, rocker lever 32 carries a roller follower 36 which is maintained in rolling contact with the rotary cam 18 by means to be subsequently described.

Link 34 is bifurcated at an end opposite from its pivotal connection with the rocker lever 32 to provide a pair of arms 38 which are individually pinned to outer ends of a pair of secondary levers 40. Levers 40 have inner ends 42 which are mounted on the cam shaft 16 and pivotable about the primary axis 20. These inner ends define oscillating cams 44, each having a base circle portion 46 and a valve lift portion 48.

The oscillating cams 44 are engaged by rollers 50 of roller finger followers 52, each having inner ends 54 which are pivotally mounted on stationary hydraulic lash adjusters 56 mounted in the engine cylinder head not shown. Outer ends 58 of the finger followers 52 engage the ends of valves 14 for directly actuating the valves in cyclic variable lift opening patterns as controlled by the mechanism. Valve springs 60 are conventionally provided for biasing the valves in a closing direction.

Figure 2:
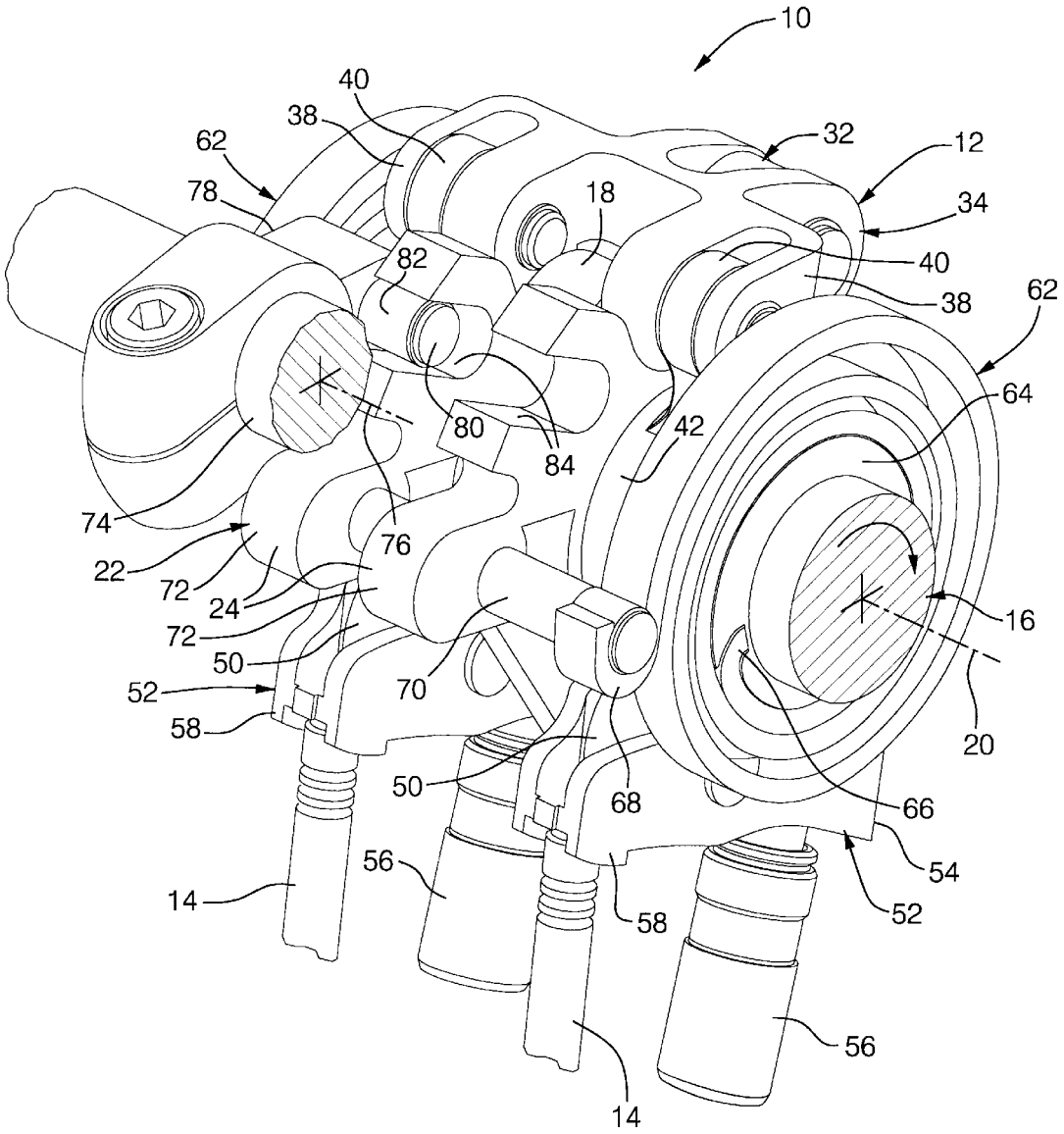
FIG. 2 is a pictorial outside view similar to FIG. 1 having portions broken away or omitted for clarity.

Because the valve springs do not apply forces that maintain the roller follower 36 against the rotary cam 18, particularly when the valves are in a low lift or no lift position, as when the finger follower rollers 50 are on the base circle of the rotary cam, biasing means are needed to maintain roller follower contact. In the illustrated embodiment, dual spiral springs 62, shown in FIG. 2, are provided for this purpose. These springs are omitted from FIGS. 3 and 4 and from the near side of FIG. 1 for clarity. Springs 62 are wrapped around outward extensions 64 from the inner ends 42 of secondary levers 40 on which the oscillating cams 44 are disposed. The springs 62 have inwardly extending tangs 66 engaging slots in the extensions 64 and spiral outward to end in reverse hooks 68 that engage opposite ends of a pin 70. Pin 70 extends through openings in biasing arms 72 formed on the individual frame elements 24 of the control member or frame 22. The dual springs apply torsional forces which continuously urge the oscillating cams 44 toward low valve lift positions (in a clockwise direction as seen in FIGS. 1, 3 and 4) and thus hold the roller follower 36 continually against the rotary cam 18.

In order to provide the variable valve lift and timing which are results of the mechanism, a control shaft 74 is provided pivotable about a secondary axis 76 parallel with and spaced from the primary axis 20. The control shaft mounts a pair of control levers 78, each carrying a drive pin 80. Each drive pin preferably carries a flat sided bushing 82 which acts as a slider and is slidable within a slot 84 provided in an arm of an associated one of the frame elements 24 of the control member 22. The slots 84 of the frame elements are angled with respect to a radial line drawn from the primary axis 20 in order to provide a variation in ratio of the movement between the control shaft 74 and the control member 22 as, will be subsequently more fully described.

In operation of the mechanism so far described, rotation of the camshaft 16 rotates the cam 18, preferably in a counterclockwise direction as shown by the arrows in FIGS. 1, 3 and 4. The cam 18 always rotates in phase with the engine crankshaft regardless of variations in the valve lift and timing events. Thus the cam oscillates the rocker lever 32 around its pivot pin 28 with a cyclic angular oscillation that is constant. As the rocker arm is pivoted outward, away from the primary axis 20, it draws the link 34 with it, in turn oscillating the secondary levers and associated oscillating cams 44 through a predetermined constant angle with each rotation of the camshaft.

FIG. 3 illustrates the position of the mechanism with the engine valves 14 closed but with the control member 22 pivoted counterclockwise to the full valve lift position. In this position, pivoting of the oscillating cams 44 by the mechanism forces the finger followers 52 downward as the oscillating cam moves from the base circle location counterclockwise until the nose of the cam is engaging the follower roller in the full valve lift position. This causes the finger follower to pivot downward, forcing the valve 14 into a fully open position. As the roller follower 36 of the rocker lever 32 rolls down the backside of rotary cam 18 to its base circle, the mechanism rotates the oscillating cams 44 clockwise, returning the finger follower rollers 50 to the base circles of the oscillating cams, thereby allowing the valves 14 to be closed by their valve springs 60 following the normal full valve lift and timing curve selected for use and operation of the engine.

To reduce the valve lift and at the same time advance the timing of peak valve lift, the control shaft 74 is rotated counterclockwise as shown in FIGS. 1, 3 and 4 to the position shown in FIG. 4. In this position the control member is rotated counterclockwise sufficiently that actuation of the rocker lever 32 by the rotary cam 18 is prevented from opening the valves because the finger follower rollers 50 are in contact only with the base circle portions 46 of the oscillating cams. To accomplish this the angular position of the control member 22 from its original position must equal the angular displacement of the oscillating cams caused by actuation of the rocker lever by the rotary cam so that the finger follower rollers never contact the valve lift portion 48 of the oscillating cams.

Figure 5:
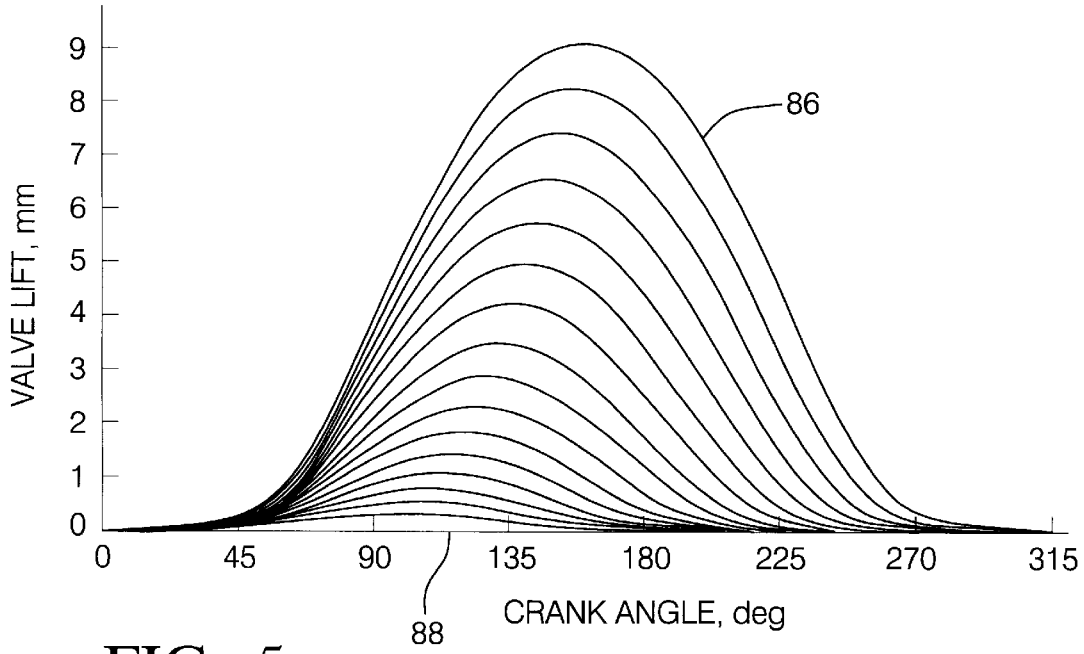
FIG. 5 is a graph illustrating a family of valve timing and lift curves for the mechanism.

FIG. 5 is a graphical presentation of valve lift in millimeters versus crankshaft angle in degrees illustrating various curves of valve lift and timing capable of being provided by the valve actuating mechanism 12. The upper curve 86 represents the valve lift and timing in the full valve lift position shown in FIG. 3 of the drawings. The straight baseline 88 of the graph represents the non-opening of the valve in the low valve lift position illustrated in FIG. 4. The intermediate lines represent a family of timing and lift curves which may be obtained at intervals between the full lift positions of FIG. 3 and the no lift position of FIG. 4.

Figure 6:
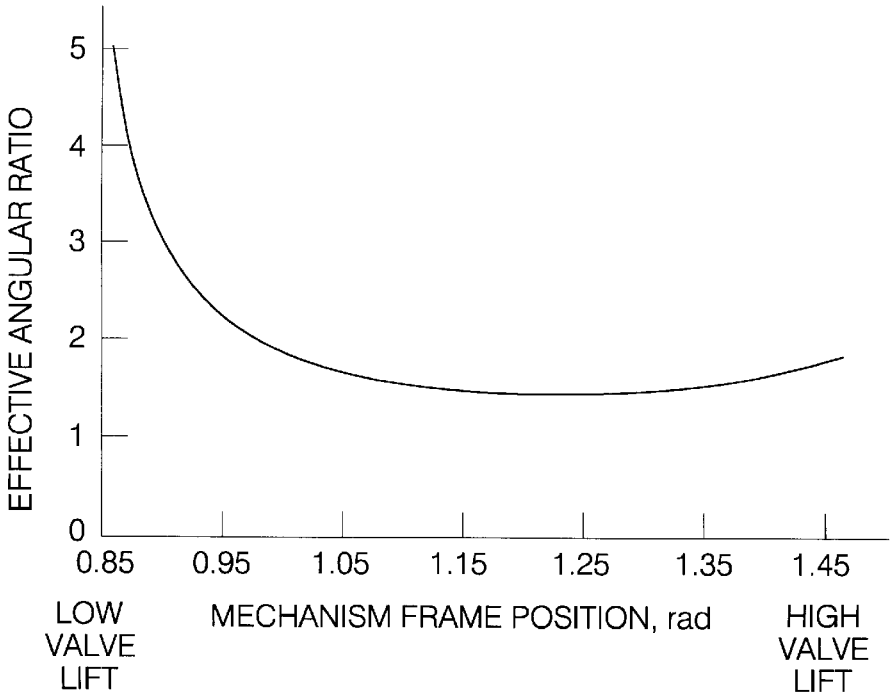
FIG. 6 is a graph of effective angular ratio vs. frame (control member) position for the mechanism.

The position of the mechanism about the primary axis 20 is determined by rotation of the control shaft 74 as previously described. Since the engine charge mass flow rate has a greater relative change at low valve lifts than at high lifts, the slider and slot connection between the control levers 78 and the dual frame elements 24 of the control member 22 is designed to use the angled slots 84 to have a variable effective angular ratio such that, at low lifts, the control shaft must rotate through a large angle for a small rotation of the control member. FIG. 6 illustrates this effective angular ratio relative to the mechanism frame position in radians at positions between low valve lift and high valve lift. It is seen that at low lifts the ratio is about 5:1 and drops off rapidly toward the middle and high lift positions to about 2:1. The result is advantageous effective control of gas flow through the inlet valves over the whole range of valve lifts.

Figure 7:
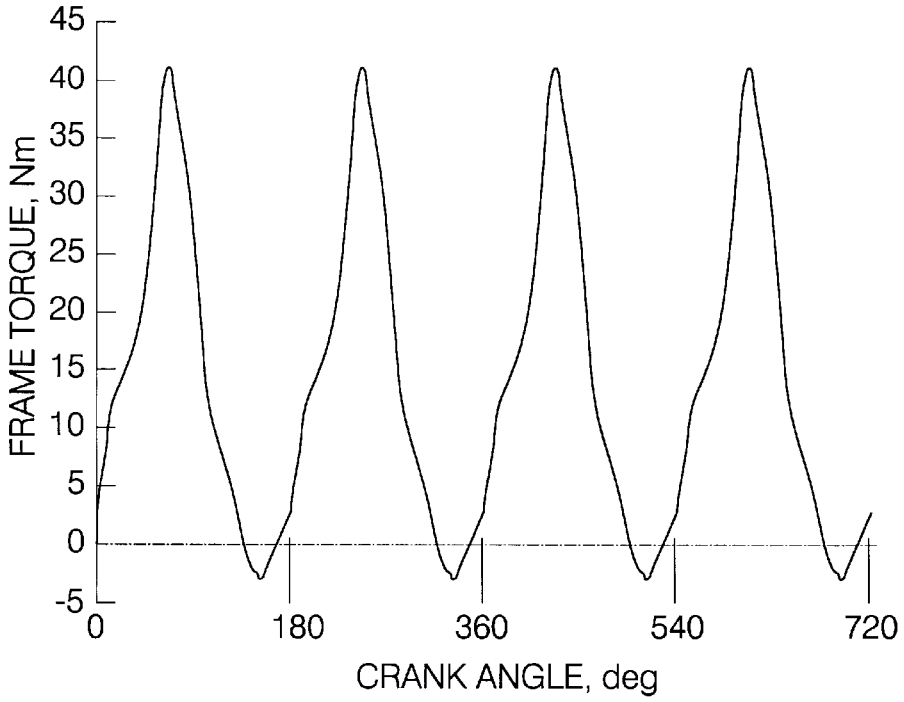
FIG. 7 is a graph of frame (control member) torque vs. engine crank angle for the mechanism.
Figure 8:
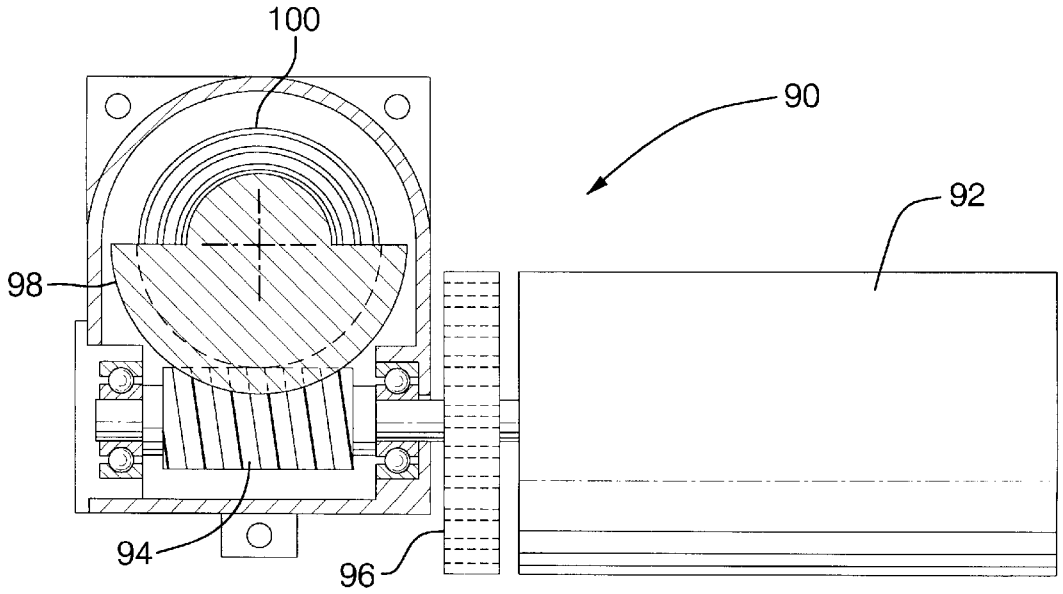
FIG. 8 is a cross-sectional view of a worm drive for actuating the control shaft of the mechanism.

FIG. 7 illustrates torques applied to the frame or control member 22 versus engine crankshaft angle in degrees for an engine having four cylinders. The control shaft is required to operate against these cyclical reversing frame torques caused by periodic valve opening and valve spring compression from each cylinder. If the actuator was required to change the mechanism position during all of the control shaft torque values, including the peak values, the actuator would need to be relatively large and expensive and consume excessive power to obtain a reasonable response time. To avoid this, FIG. 8 illustrates a worm gear actuator 90 proposed for driving the control shaft 74 to its various angular positions. Actuator 90 includes a small electric drive motor 92 driving a worm 94 through a shaft that may be connected with a spiral return spring 96. The worm 92 engages a worm gear 98 formed as a semi-circular quadrant. The worm gear is directly attached to an end, not shown, of the control shaft 74 for rotating the control shaft through its full angular motion. The pressure and lead angles of the teeth of the worm and the associated worm gear are selected as a function of the friction of the worm and the worm gear so that back forces acting from the worm gear against the worm will lock the gears against motion until the back forces are reduced to a level that the drive motor 92 is able to overcome.

Thus in operation, when a change in position of the mechanism control member is desired, the drive motor 92 is operated to rotate the worm 94 and associated worm gear 98 in the desired direction. A spiral torque biasing spring 100 is applied to the worm gear 98 (or the control shaft 74) to bias the drive forces so as to balance the positive and negative control shaft torque peaks so that the actuator is subjected to equal positive and negative torques. The biasing spring 100 will thus balance the system time response in both directions of actuation. When the torque peaks are too high in the direction against the rotation of the motor, the worm drive will lock up, stalling the motor until the momentary torques are reduced and the motor again drives the mechanism in the desired direction with the assistance of torque reversals acting in the desired direction. The result is that a relatively low powered motor is able to provide the desired driving action of the control shaft and actuate the mechanisms with the relatively efficient expenditure of power. If used, the return spring 96 is installed so as to cause the actuation system to default to a low lift position during engine shutdown.

It should be apparent that the mechanism illustrated and many of its features could take various forms as applied to other engine applications. For example, single VVT mechanisms could be applied to each finger follower of an engine so that valves could be actuated differently. Alternatively, dual actuators could be installed in a single bank of valves that could allow separate inlet valve control between two inlet valves of each cylinder. In another alternative, one actuator per bank of valves could be applied but different profiles on the individual oscillating cams of each cylinder could allow one valve to have a smaller maximum lift than the other so that the valve timing between the two valves could be changed as desired. Such an arrangement would enable low speed charge swirl while still maintaining a single computer controlled actuator. If desired, the mechanism of the invention could also be applied to the actuation of engine exhaust valves or other appropriate applications.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

We claim:

1. Valve actuating mechanism comprising:

a rotary cam rotatable about a primary axis;

a control member pivotable about said primary axis and including a first pivot axis spaced from said primary axis;

a primary lever connected with said control member and pivotable about said first pivot axis, said primary lever having a distal end and a cam follower operatively connected intermediate said distal end and the first pivot axis, said cam follower operatively engaging said rotary cam; and a secondary lever having one end pivotable about said primary axis, said one end including an oscillating cam engaging a valve actuating member and having a base circle portion and a valve lift portion, the secondary lever having a distal end operatively connected with the distal end of said primary lever;

said control member being movable between a first angular position wherein primarily the valve lift portion of said oscillating cam engages a valve actuating member for fully opening and closing an associated valve and a second angular position wherein primarily the base circle portion of said oscillating cam engages the valve actuating member for providing minimal opening and closing movement of said associated valve;

said mechanism including a control lever pivotable about a secondary axis and connected to the control member through a slide and slot connection arranged such that angular motion of the control lever relative to the control member has a relatively higher angular ratio in a low valve lift range than in an intermediate valve lift range.

2. Valve actuating mechanism as in claim 1 wherein said angular ratio has a maximum ratio more than twice the minimum ratio.

3. Valve actuating mechanism as in claim 1 wherein a slot is formed in the control member and a slide includes a pin on the control lever and operatively engaging the slot, the slot being angled from a radial direction to provide the higher angular ratio in the low valve lift range.

4. Valve actuating mechanism as in claim 3 including a flat sided bushing on the pin and slidably engaging the slot.

5. Valve actuating mechanism as in claim 1 including biasing means urging the cam follower of the primary lever toward the rotary cam.

6. Valve actuating mechanism as in claim 5 wherein the biasing means is a spiral spring acting between said oscillating cam and the control member to draw the roller follower against the rotary cam.

7. Valve actuating mechanism as in claim 5 including a control shaft operatively engaging the control member for pivotal movement between said first and second angular positions; and a control shaft actuator operatively connected to selectively provide powered rotation of the control shaft, said actuator including means for preventing rotation of the control shaft opposite a direction of selected powered rotation.

8. Valve actuating mechanism as in claim 7 wherein the control shaft actuator is a worm drive having worm tooth angles selected to prevent back driving of the actuator from mechanism forces applied against the control shaft.

* * * * *